US009464455B2

(12) United States Patent
Montgomery

(10) Patent No.: US 9,464,455 B2
(45) **Date of Patent: *Oct. 11, 2016**

(54) THEMED CEMETERY SYSTEMS AND METHODS

(71) Applicant: David Montgomery, Ladera Ranch, CA (US)

(72) Inventor: David Montgomery, Ladera Ranch, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/452,773

(22) Filed: Aug. 6, 2014

(65) Prior Publication Data

US 2015/0081595 A1 Mar. 19, 2015

Related U.S. Application Data

(63) Continuation-in-part of application No. 14/090,999, filed on Nov. 26, 2013, which is a continuation-in-part of application No. 12/606,977, filed on Oct. 27, 2009, now Pat. No. 8,615,855.

(60) Provisional application No. 61/108,670, filed on Oct. 27, 2008.

(51) Int. Cl.

| | |
|---|---|
| ***E04H 13/00*** | (2006.01) |
| ***G06Q 99/00*** | (2006.01) |
| *E04H 3/12* | (2006.01) |

(52) U.S. Cl.

CPC ..... *E04H 13/00* (2013.01); *E04H 13/003* (2013.01); *E04H 13/008* (2013.01); *G06Q 99/00* (2013.01); *E04H 3/12* (2013.01); *E04H 13/006* (2013.01)

(58) Field of Classification Search

CPC . E04H 13/001; E04H 13/003; E04H 13/005; E04H 13/006; E04H 13/008

See application file for complete search history.

(56) References Cited

U.S. PATENT DOCUMENTS

| | | | | | |
|---|---|---|---|---|---|
| 1,096,758 | A * | 5/1914 | Rogers | E04H 13/005 | 52/132 |
| 4,688,359 | A * | 8/1987 | See | A61G 17/08 | 52/104 |
| 4,977,652 | A * | 12/1990 | Graham | E04H 13/006 | 27/1 |
| 5,408,786 | A * | 4/1995 | Konno | E04H 13/006 | 27/1 |

(Continued)

*Primary Examiner* — Ryan Kwiecinski

(74) *Attorney, Agent, or Firm* — Rutan & Tucker LLP; Hani Z. Sayed

(57) ABSTRACT

An improved cemetery experience, whereby the cemetery and accompanying facilities may celebrate and demonstrate the passion and hobbies of the deceased individual, such as a love of special venues, e.g., amusement and entertainment venues. The contemplated themed cemetery may be a stand-alone cemetery that celebrates a common passion of a plurality of individuals, yet still maintains the traditional burial and memorialization process. The themed cemetery memorializes a specific event or a loved location and provides enjoyment to individuals having a common interest with an opportunity for burial and/or memorial with a common theme. The themed cemetery comprises a visual and physical replica of a venue, such as a entertainment facility, e.g., Grauman's Chinese Theater, the Hollywood Bowl, The Hollywood Palladium, Disneyland, The Walt Disney Concert Hall, The Greek Theater, Cesar's Palace, The MGM Grand Hotel, The Bellagio, and the like. The themed cemetery is configured to providing space for the deceased while also providing income and revenue by way of advertising for a cemetery operator, a franchisor, and/or a franchisee.

17 Claims, 10 Drawing Sheets

(56) References Cited

U.S. PATENT DOCUMENTS 6,052,954 A * 4/2000 Dudek ..... A61G 17/08 27/7
6,261,028 B1 * 7/2001 Volpe ..... E04H 13/006 27/1
6,662,416 B1 * 12/2003 Huggins ..... E04H 13/008 27/1
6,681,534 B2 * 1/2004 David ..... E04H 13/00 27/1
6,799,399 B2 * 10/2004 Dudek ..... E04H 13/00 27/7
6,854,165 B1 * 2/2005 Parker ..... A61G 17/08 27/1
7,036,196 B2 * 5/2006 Salatin ..... A47B 95/008 211/85.16
7,089,495 B2 * 8/2006 Barrows ..... E04H 13/003 360/12
7,127,783 B1 * 10/2006 Poole et al. ..... 27/1
7,165,297 B2 * 1/2007 Poole, Jr. ..... E04H 13/008 27/1
7,421,765 B1 * 9/2008 Kaiser ..... A61G 17/00 27/1
7,900,327 B2 * 3/2011 Elhaj ..... A61G 17/00 27/35
8,196,274 B2 * 6/2012 Heckenbach ..... A61G 17/08 27/1
2001/0036354 A1 * 11/2001 Majors ..... E04H 13/003 386/231
2002/0133360 A1 * 9/2002 Hill ..... G06Q 30/02 705/500
2003/0145533 A1 * 8/2003 Dudek ..... E04H 13/00 52/128
2006/0053604 A1 * 3/2006 Brine ..... G06Q 50/10 27/1
2010/0075767 A1 * 3/2010 Correll ..... A63G 31/00 472/136
2010/0101158 A1 * 4/2010 Montgomery ..... A61G 99/00 52/103
2010/0313395 A1 * 12/2010 Heckenbach ..... A61G 17/08 27/1
2011/0126480 A1 * 6/2011 Tsao ..... E04H 13/006 52/133
2011/0161254 A1 * 6/2011 Van Den Bogart ... E04H 13/003 705/500
2012/0227227 A1 * 9/2012 Heckenbach ..... A61G 17/08 27/1

* cited by examiner

THEMED CEMETERY SYSTEMS AND METHODS

CROSS-REFERENCE TO RELATED APPLICATIONS

This document is a continuation-in-part application claiming the benefit of and priority to U.S. patent application Ser. No. 14/090,999, entitled "Themed Cemetery System," filed on Nov. 26, 2013, claiming the benefit of, and priority to U.S. patent application Ser. No. 12/606,977 also entitled "Themed Cemetery System," filed on Oct. 27, 2009, now issued as U.S. Pat. No. 8,615,855, claiming the benefit of and priority to U.S. Provisional Patent Application Ser. No. 61/108,670 also entitled "Themed Cemetery System" filed on Oct. 27, 2008, all of which are incorporated herein by reference in their entirety for all purposes.

TECHNICAL FIELD

The subject matter of the present disclosure is technically related to undertaking and cemeteries. More specifically, the subject matter of the present disclosure is technically related to cemetery systems and methods. Even more specifically, the subject matter of the present disclosure is technically related to cemetery systems and methods involving a themed and other unique configurations.

BACKGROUND

Cemeteries and different burial places have been contemplated from the beginning of time. The human race has always desired the best ways to respect and bury their dead. The type of burial has changed over the centuries to include burning, burying, sending out to sea, building elaborate burial structures and the like.

The two most common types of burial methods today are cremation and casket burial. In more recent times, cremation has become more prevalent and is a little less expensive as it does not require acquiring a plot, or tombstone/gravestone. However, what is actually done with the cremation remains is often up to the families or the deceased. Many wish their ashes to be spread or placed at certain locations and others are stored by loved ones. The second traditional method of burial includes the use of a casket, plot and gravestone/mausoleum. The dead are prepared for burial, placed in a casket, and lowered into the ground. A gravestone or mausoleum is placed on top of the burial site to mark where the deceased is located. Typically, prior art cemeteries are parks with trees, grass and other park-like structures. Some prior art cemeteries are located on church grounds or other holy sites. Cremation remains are also sometimes found at these similar locations.

However, no significant developments have been made in the cemetery industry for some time. One way of denoting the interests and hobbies of the deceased individual is to carve the information directly onto the deceased headstone or gravestone. The information provided may give some idea of the individual's personal life, hobbies or other information that may immediately denote some characteristic or personal trait of the individual. Outside the markings of a headstone or gravestone, it is often very difficult to identify characteristics about the individual that may have identified their personal traits, interests or hobbies.

Therefore, a need exists for a new and unique cemetery theme that may allow the deceased some options when considering where and how to be buried. Additionally, a need exists for an improved cemetery which may provide greater deference and options to individuals that may be dictated by personal interests and hobbies while still giving the options for the type of burial ceremony, including cremation and/or traditional casket burial. Moreover, a need exists for an improved themed cemetery system that may celebrate the common passion in the memorialization process, yet still give diverse burial options.

SUMMARY

The present disclosure provides an improved cemetery experience whereby the cemetery and accompanying facilities may celebrate and demonstrate the passion and hobbies of the deceased individual. The contemplated themed cemetery system may be a stand-alone cemetery that celebrates a common passion of a plurality of individuals, yet still maintains the traditional burial and memorialization process. The themed cemetery system may take a specific event, or commonly understood and loved location and memorialize that location in the themed of a cemetery where those with that common interest and enjoyment of the commonly understood location may desire to be buried. The cemetery would closely resemble both visually and physically a replica of the themed being celebrated and may provide space for the deceased while still providing adequate income and revenue in the way of advertising for the operator, franchisor, and/or franchisee.

Among the many different possibilities contemplated, a themed cemetery system may be provided for burial of the deceased. In exemplary embodiments, the cemetery comprising: a portion of property replicating at least a venue both physically and visually; a plurality of plots located within the famous venue; said plots capable of holding traditional caskets and cremated remains; and at least a portion of the famous structure having advertising space thereon.

To this end, in an exemplary embodiment of the present invention, a themed cemetery system, comprising: a property simulating a entertainment facility comprising at least one entertainment themed, the property comprising: at least one portion simulating at least one entertaining area of the entertainment facility; a plurality of burial plots located in relation to the property simulating the entertainment facility, each plot of the plurality of burial plots capable of accommodating at least one of a casket, an urn, a mausoleum, and contents thereof, each plot comprising a distinct revenue value relative to any other plot at a given time, and the distinct revenue value depending on a location of each plot within the property simulating the entertainment facility; and at least a portion comprising at least one advertising space.

In an exemplary embodiment, wherein the at least one entertainment themed comprises at least one of live theatre, cinema, concert, an art exhibition, a television, radio, gambling, convening, resort, and any other form of entertainment, wherein entertainment includes music, art, performing art, cinema, television, any other amusement associated with a venue.

In an exemplary embodiment, wherein the at least one advertising space is disposed in relation to at least one wall of the property.

In an exemplary embodiment, wherein the at least one advertising space is disposed on the property in manner that is consistent with at least one advertising and promotional space of the entertainment facility.

In an exemplary embodiment, further comprising a plurality of burial headstones having memorabilia related to the entertainment facility.

In an exemplary embodiment, wherein the property further comprises at least one seating area.

In an exemplary embodiment, wherein the at least one entertaining area comprises a first area and a second area, the first area comprising a plurality of generally uniform, ground level tombstones at a first revenue value, and the second area comprising a plurality of ornate tombstones at a second revenue value, the second revenue value being higher than the first revenue value.

In an exemplary embodiment, wherein the plurality of generally ground level tombstones of the first area are disposed in a manner resembling a entertaining surface for the entertainment facility.

In an exemplary embodiment, wherein the plurality of ornate tombstones of the second area comprises a plurality of headstones corresponding to a plurality of specific memorials. In exemplary embodiments, wherein the plurality of specific memorials comprises at least one at least one representation of an entertainment poster, a stage actor, a movie star, a television star, a celebrity, an entertainment personality, a studio owner, a studio executive, a reality show personality, an online personality, a newscaster, a broadcaster, and the like.

In an exemplary embodiment, wherein the first area comprises a plurality of ornamental features consistent with the at least one entertainment themed of the entertainment facility.

In another exemplary embodiment, a method for creating a themed cemetery, the method comprising: providing a property simulating a entertainment facility comprising at least one entertainment themed, the property comprising: providing at least one portion simulating at least one entertaining area of the entertainment facility; providing a plurality of burial plots located in relation to the property simulating the entertainment facility, each plot of the plurality of burial plots capable of accommodating at least one of a casket, an urn, a mausoleum, and contents thereof, each plot comprising a distinct revenue value relative to any other plot at a given time, and the distinct revenue value depending on a location of each plot within the property simulating the entertainment facility; and providing at least a portion comprising at least one advertising space.

In an exemplary embodiment, wherein providing the at least one entertainment themed comprises providing at least one of live theatre, cinema, concert, an art exhibition, a television, radio, gambling, convening, resort, and any other form of entertainment, wherein entertainment includes music, art, performing art, cinema, television, any other amusement associated with a venue.

In an exemplary embodiment, wherein providing the at least a portion, comprising the at least one advertising space, comprises disposing the at least one advertising space in relation to at least one wall of the property.

In an exemplary embodiment, wherein providing the at least a portion, comprising the at least one advertising space, comprises disposing the at least one advertising space on the property in a manner that is consistent with at least one advertising and promotional space of the entertainment facility.

In an exemplary embodiment, further comprising providing a plurality of burial headstones having memorabilia related to the entertainment facility.

In an exemplary embodiment, wherein providing the property further comprises providing at least one seating area.

In an exemplary embodiment, wherein providing the at least one portion, simulating at least one entertaining area, comprises providing the at least one entertaining area with a first area and a second area, the first area providing comprising providing generally uniform, ground level tombstones at a first revenue value, and the second area providing comprising providing ornate tombstones at a second revenue value, the second revenue value being higher than the first revenue value.

In an exemplary embodiment, wherein providing the plurality of generally ground level tombstones of the first area comprises disposing the generally ground level tombstones in a manner resembling a entertaining surface for the first area, wherein providing the plurality of ornate tombstones of the second area comprises providing the headstones corresponding to specific memorials, and wherein providing the plurality of headstones corresponding to specific memorials comprises providing at least one representation of an entertainment poster, a stage actor, a movie star, a television star, a celebrity, an entertainment personality, a studio owner, a studio executive, a reality show personality, an online personality, a newscaster, a broadcaster, and the like.

In an exemplary embodiment, wherein providing the at least one entertaining area comprises providing the first area with ornamental features consistent with the at least one entertainment themed of the entertainment facility.

In an exemplary embodiment, the themed cemetery system venue comprises at least one of a baseball stadium, a golf course, a football stadium, an automobile racetrack, a casino, a building, and/or any other notable structure.

In an exemplary embodiment, the themed cemetery system plots are capable of holding human remains whereby the plots may have different revenue value depending on location within the famous venue.

In an exemplary embodiment, the themed cemetery system advertising space is provided on the outside walls of the famous venue.

In an exemplary embodiment, the themed cemetery system advertising and promotional space is provided within the venue to coincide with the advertising and promotional space provided at the corresponding real world facility for which the cemetery is modeled after.

In an exemplary embodiment, the themed cemetery system advertising space is provided in the same locations where advertising is found in a real life famous venue.

In an exemplary embodiment, the themed cemetery system further comprises: unique burial headstones having personal preferences that relate to the famous venue.

In yet another exemplary embodiment, a method for creating a themed cemetery system is provided. The method comprising the steps of: providing a property which replicates at least a landmark venue both physically and visually; providing a plurality of plots located at different locations within the landmark venue; said plots located at different locations whereby said different locations being capable of holding either traditional caskets or cremated remains; and at least a portion of the famous structure having advertising space thereon.

In an exemplary embodiment, the method further comprises the step of: providing areas within the landmark venue capable of holding human remains whereby the plots have assigned values depending on the location within the landmark venue.

In an exemplary embodiment, the method further comprises the step of: allowing deceased individuals to be buried in a familiar location to social activities that the deceased member was involved in during their life, which is associated with the landmark venue.

In an exemplary embodiment, the method further comprises the step of: providing a seating area for visitors coming to the landmark venue whereby space is provided in the seating area for placement of deceased individuals' remains.

In an exemplary embodiment, the method further comprises the step of: said landmark venue being any of: a baseball stadium, a golf course, a basketball, hockey, football stadium, a car racing park, a traditional park, a casino, building, racetrack, famous landmark, structure or building.

In an exemplary embodiment, the method further comprises the step of: providing preferred locations within the landmark venue whereby the preferred locations provide increased revenue for burial at those locations.

In an exemplary embodiment, the method further comprises the step of: providing monuments, articles and memorabilia which are incorporated into the landmark venue to simulate and conjure up memories of the real world facility for which the themed cemetery system is modeled thereafter.

In an exemplary embodiment, the method further comprises the step of: providing unique burial headstones and plots which have personal preferences and memorabilia that relate to the landmark venue.

In an exemplary embodiment, the method further comprises the step of: providing advertising and promotional space within the venue to coincide with the advertising and promotional space provided at the corresponding real world facility for which the cemetery is modeled after.

Additionally, in an exemplary embodiment, a themed cemetery system may be provided whereby the cemetery may deliver a visual and a substantially similar replica of the themed being celebrated.

In yet another exemplary embodiment, it is contemplated that the themed cemetery system may take the form of a scaled replica of a famous golf course.

In another exemplary embodiment, it is contemplated that the themed cemetery system may take the form of a scaled replica of a football stadium such as Soldier Field, Lambeau Field, or Qualcomm Stadium.

A further exemplary embodiment contemplates that the themed cemetery system may be formed to replicate a baseball stadium such as Wrigley Field, Fenway Park or Yankee Stadium.

In yet another exemplary embodiment, the themed cemetery system may be adapted to replicate a driving forum such as the Daytona 500 and/or Talladega.

Additionally, in an exemplary embodiment, the themed cemetery system may be adapted to replicate a famous casino, a famous building or any other structure, themed or hobby that may have been of interest to a plurality of deceased individuals.

In yet another exemplary embodiment of the present disclosure, the themed cemetery system may celebrate a common passion and/or themed in every aspect of the traditional burial and memorialization process.

Still another exemplary embodiment of the present disclosure is to provide a themed cemetery system whereby the themed is celebrated through the unique property design.

Yet another exemplary embodiment of the present disclosure is to provide a themed cemetery system whereby the cemetery is specifically customized as a funeral and/or burial service with diverse burial options.

Still another exemplary embodiment is to provide a themed cemetery system whereby the operators and creators of the cemetery would make every effort to deliver a visual and physical replica of the original venue to be celebrated, whether it may be a stadium, building or golf course.

Another exemplary embodiment of the disclosure is to provide a themed cemetery system whereby the themed may be a NASCAR race track.

In yet another exemplary embodiment, a themed cemetery system may be provided whereby the themed cemetery system may utilize and capture the excitement of being at the actual themed event which the cemetery is designed after.

A further exemplary embodiment is to provide a themed cemetery system whereby the physical size of the cemetery would be substantial in an effort to capture the feel of the true stadium, building, or venue.

Another exemplary embodiment is to provide a themed cemetery system whereby the cemetery may have various portions thereof which may be of higher value to certain individuals, including bleachers which an individual may have spent a lot of time in, or premium boxes which may have been a favorite for the deceased. Similarly, an individual may wish to be buried in an infield portion of a stadium, or the pit area of a NASCAR themed cemetery system, which may be chosen by the individual depending on their tastes.

A further exemplary embodiment is to provide a themed cemetery system whereby the themed concept may be followed through in a design to include things like stadium seating that may be designed as community niches, which from a quantity standpoint may be most prevalent.

Still another exemplary embodiment is to provide a themed cemetery system whereby the themed concept may be followed through in a design to include aspects such as viewing towers and private box niches, pit areas, winner's circles for car and horse racing venues, in-fields and end zones in stadium venues, and even outside walls that may be utilized to store the cremated remains of an individual.

Yet another exemplary embodiment is to provide a themed cemetery system whereby the themed cemetery system may also include a revenue stream for the operators by allowing advertising which have become common in most venues. The operator may sell advertising space on the outside walls, the pit areas, or box areas as are commonly found in most sporting venues. Thereby the operator of the cemetery may generate multiple revenue streams and may change the advertising space in the same manner as most venues change advertising space and use depending on time and other factors.

In another exemplary embodiment, the themed cemetery system may be provide whereby the themed cemetery system may be constructed to constitute any of a plurality of sporting or leisure events including baseball, basketball courts, hockey rinks, horse racing grounds, children's playgrounds, favorite restaurants, specific city buildings, country buildings, miniaturized landmarks, and the like.

In still another exemplary embodiment, unique tombstones, headstones and gravestones may be utilized to demonstrate a particular individual's interest in that venue. For example, an individual may have a personal connection to a certain individual car, green (for golf) or player, whereby the individual may utilize unique headstones that display their preferences within the themed cemetery system.

In an embodiment of the present disclosure, a themed cemetery system comprises: a property simulating a entertainment facility comprising at least one entertainment themed, the property comprising: at least one portion simulating at least one entertaining area of the entertainment facility; a plurality of burial plots located in relation to the property simulating the entertainment facility, each plot of the plurality of burial plots capable of accommodating at least one of a casket, an urn, a mausoleum, and contents thereof, each plot comprising a distinct revenue value relative to any other plot at a given time, and the distinct revenue value depending on a location of each plot within the property simulating the entertainment facility; and at least a portion comprising at least one advertising space.

In another embodiment of the present disclosure, a method of creating a themed cemetery comprises: providing a property simulating a entertainment facility comprising at least one entertainment themed, the property comprising: providing at least one portion simulating at least one entertaining area of the entertainment facility; providing a plurality of burial plots located in relation to the property simulating the entertainment facility, each plot of the plurality of burial plots capable of accommodating at least one of a casket, an urn, a mausoleum, and contents thereof, each plot comprising a distinct revenue value relative to any other plot at a given time, and the distinct revenue value depending on a location of each plot within the property simulating the entertainment facility; and providing at least a portion comprising at least one advertising space.

Various objects, features, aspects and advantages of the present disclosure will become more apparent from the following detailed description of preferred embodiments of the disclosure, along with the accompanying drawings in which like numerals represent like components.

BRIEF DESCRIPTION OF THE DRAWING

The above, and other, aspects, features, and advantages of several embodiments of the present disclosure will be more apparent from the following Detailed Description as presented in conjunction with the following several figures of the Drawing.

Figure 1:
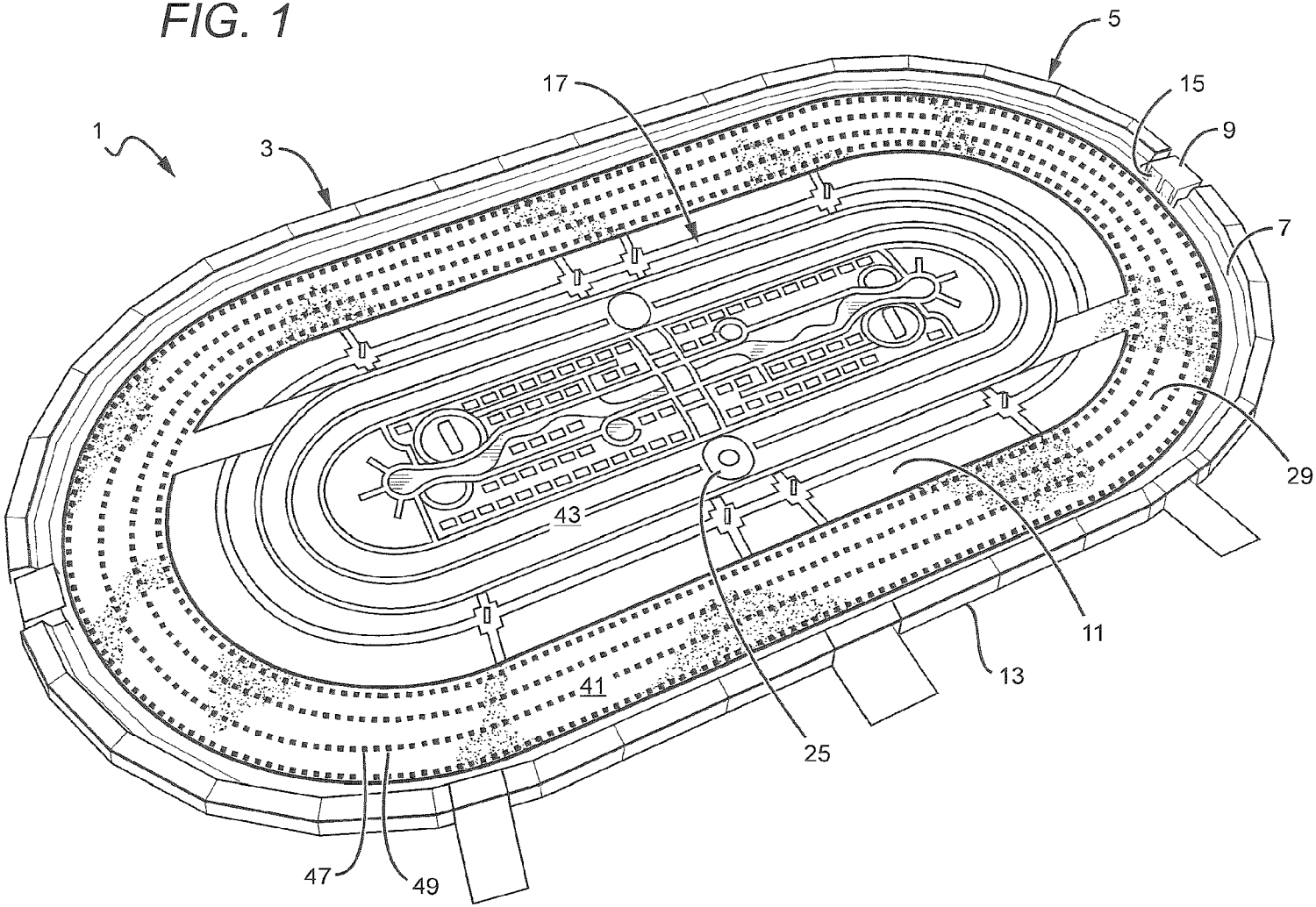
FIG. 1 is a schematic diagram illustrating a perspective view of a themed cemetery system, comprising a racetrack configuration, in accordance with an embodiment of the present disclosure.

Corresponding reference characters or reference numerals indicate corresponding components throughout the several figures of the Drawing. Elements in the several figures are illustrated for simplicity and clarity and have not necessarily been drawn to scale. For example, the dimensions of some elements in the figures may be emphasized relative to other elements for facilitating understanding of the various presently disclosed embodiments. Also, well-understood elements that are useful or necessary in commercially feasible embodiments are often not depicted in order to facilitate a less obstructed view of these various embodiments of the present disclosure.

DETAILED DESCRIPTION

The following description is not to be taken in a limiting sense, but is made merely for the purpose of describing the general principles of exemplary embodiments. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. That the embodiments of the present disclosure can be practiced, without one or more of the specific details, or with other methods, components, materials, and so forth is contemplated as being encompassed by the present disclosure.

The following description of any preferred embodiment(s) is merely exemplary in nature and is in no way intended to limit the disclosure, its application, or uses. For ease of description, only one exemplary embodiment is herein described in detail. However, understood is that any of a plurality of embodiments may utilize the same themed cemetery system construction for many different themed including stadiums, landmarks, buildings, parks, and the like, and are encompassed by the present disclosure. Understood is that the use of a car racing stadium is utilized only for illustration purposes only and is in no way limited to only race car stadiums.

Referring to FIG. 1, this schematic diagram illustrates an overall perspective view of a themed cemetery system 1, in accordance with an embodiment of the present disclosure. The themed cemetery system 1 may take any of a plurality of shapes and sizes, depending on the desires and accommodations necessary for those wishing to be accommodated, e.g., interred, at the location. The themed cemetery system 1 comprises a representation of a car racing facility 3 as illustrated in FIG. 1, but themed cemetery system 1 may also comprise a representation of any preferred landmarks, including sports stadiums, arenas, famous landmarks such as parks, buildings, structures, vehicles, trains, planes and the like. For illustrative purposes, FIG. 1 illustrates a themed cemetery system 1 in the form of a racing car facility 3 such as those found in famous car racing tracks like Daytona raceway, (not shown) California raceway, e.g., Irwindale Raceway or Laguna Seca Raceway (not shown), and/or the Indianapolis raceway (not shown).

Still referring to FIG. 1, the themed cemetery system 1 in the form of a racing car facility 3 may have a plurality of sections included therein. For example, the racing car facility 3 may have many of the same features commonly found on the actual racing car facility 3 for which it is modeled. The themed cemetery system 1 may include grandstand areas 5, commonly found in most real world racing car facilities. The grandstand areas 5 may include a plurality of areas including at least a seating area 7, media box areas 9, and grandstand burial areas 11. It is contemplated that the grandstand 5 take the same form and shape as the real world racing car facilities and be approximately the same relational size to the real facilities.

Still referring to FIG. 1, the grandstand areas 5 of the themed cemetery system 1 may have a seating area 7 which may be used by those individuals that come to visit those accommodated, e.g., interred, there. The seating area 7 of the grandstand areas 5 may also provide an area which may be suitably familiar to the individuals that may be visiting loved ones buried in the themed cemetery system 1. For example, friends that may have attended baseball games together and held season passes or attended race car events together and sat in the same location for years, may desire to sit in those same locations in the grandstand areas 5 when visiting the friends and/or relatives that may be buried at the themed cemetery system 1. A greater sense of familiarity may be provided with the seating area 7 of the grandstand 5. Moreover, providing adequate seating area 7 may also allow for the accommodation of more people in the themed cemetery system 1 and may also relax some of the anxiety related to visiting individuals at a cemetery.

Still referring to FIG. 1, the themed cemetery system 1 may also have a grandstand area 5 which may include media boxes 9 or luxury boxes. These media/luxury boxes 9 may be located in similar locations as those in the real world facilities. Many individuals have luxury boxes and a great deal of their social life while they were alive revolved around these luxury boxes 9. These media/luxury boxes 9 may be utilized as either visitor areas or, in the alternative, may be utilized as burial areas for those wishing to be buried in the areas in which the deceased has spent so much time. However, as these media/luxury boxes 9 in real life cost significantly more than regular seating areas 7, similarly, the media/luxury boxes 9 may cost more to be buried therein which may increase the exclusivity and profitability to the owner of the themed cemetery system 1 facility. The luxury boxes 9 may encompass the entirety of the outside edge 13 of the themed cemetery system 1 and may have the added advantage of looking out away from the themed cemetery system 1 to property located adjacent (not shown). These luxury boxes 9 may include similar characteristics as those found in the real world facilities including glass 15 which looks towards the infield area 17, the grandstand seating area 7 and even into the winning circle 25, and the track 29 itself.

Still referring to FIG. 1, the grandstand areas 5 comprise a grandstand burial area 11. As enumerated above, many individuals may have spent much of their time at a particular sporting event, such as season tickets for baseball games where the season ticket holder held the same seats for many years. The themed cemetery system 1 may provide the individual with the ability to be buried or accommodated, e.g., interred, in much the same location or seating area where that individual may have spent so much of their leisure time. Additionally, visitors that knew the individual well, would know that the individual had been buried in the grandstand burial area 11 at a location that was close or at the location where that individual spent much of their leisure time. Many visitors may have at one point or the other, gone to a sporting event with the person accommodated, e.g., interred, or buried there and may have fond memories of their time with that individual. The grandstand burial area 11 may also provide nostalgic and/or fond memories for the individuals that visit the deceased, creating a positive atmosphere as opposed to the deserted, and desolate prior art cemetery grounds that provide the atmosphere that would provoke the fond and happy memories, thereby creating a positive cemetery visitor experience.

Still referring to FIG. 1, the track area 29 of the themed cemetery system 1 car racing facility 3 is shown. The track area 29 could be akin to the baseball field, football field, etc. of another type of facility and is utilized for illustrative purposes only. The track area 29 may have been the focus of the deceased individuals' attention when they were participating or viewing the event. The individual may have some fondness for being buried in the place for which they focused so much of their attention. From the facility owner's standpoint, the track area 29 or the field area in the case of a baseball field, or football field may comprise the majority of the area of the facility and may be the least expensive portion of the themed cemetery system 1 to buy. Moreover, because the track area 29 may comprise a large portion of the surface area of the themed cemetery system 1, the facility owners may utilize the space to promote aesthetic features of the cemetery 1 including different vegetation/plants 31, along with statues 81, benches 37 (see also FIG. 2), and the like. The track area 29 may allow for a park-like atmosphere which includes plants 31, traditional seating areas 37 and walkways 39 which may allow visitors to walk around the track area 29 to view other parts of the themed cemetery system 1, sit in the grandstand areas 5 and to find the appropriate loved family or friend that may be accommodated, e.g., interred, or buried at a particular location within the track area 29.

Figure 2:
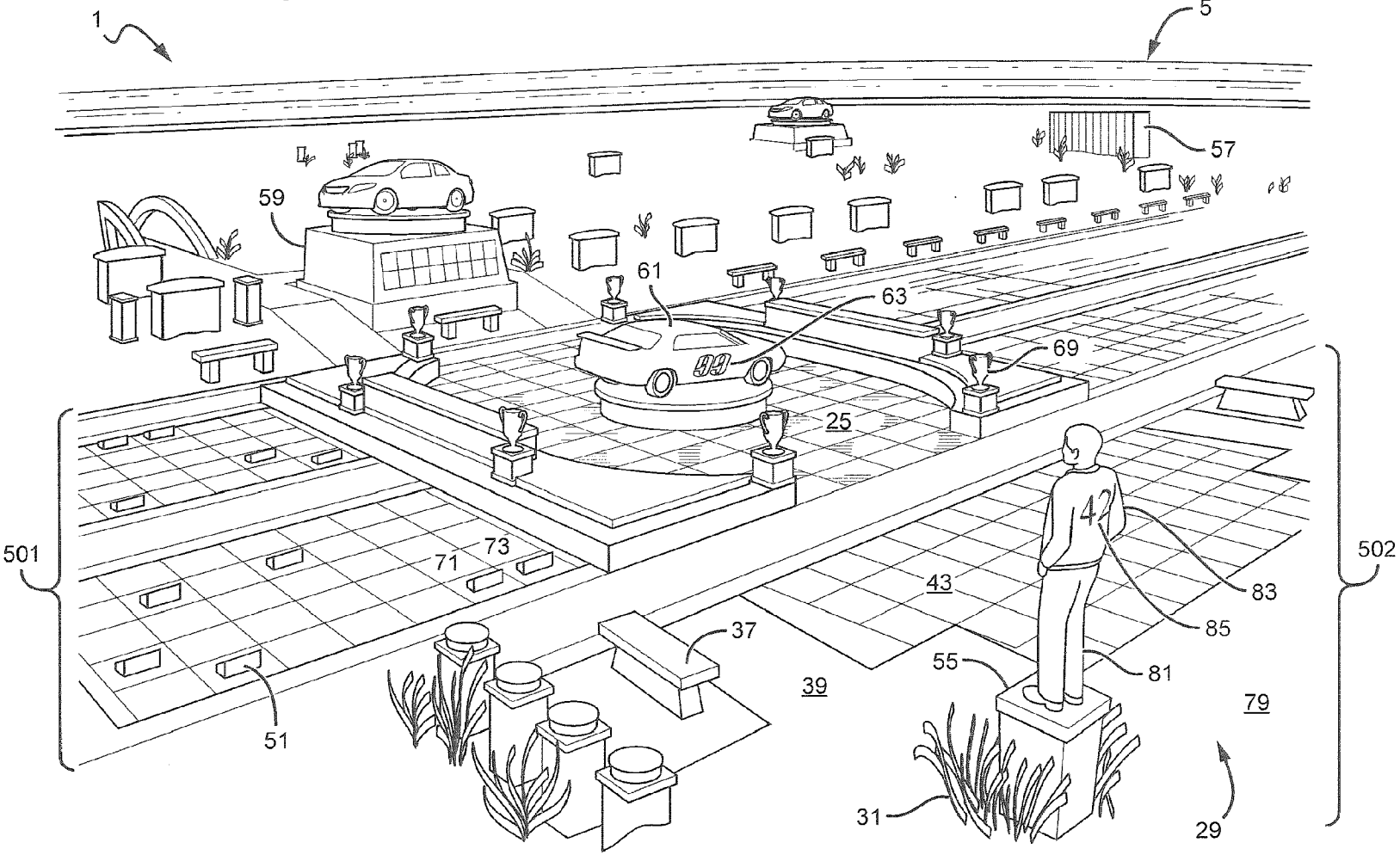
FIG. 2 is a schematic diagram illustrating a perspective view of a themed cemetery system, including an entrance area and a grandstand area, in accordance with an embodiment of the present disclosure.

Referring to FIG. 2, this schematic diagram illustrates the track area 29 comprising a first area 41 and a second area 43, in accordance with an embodiment of the present disclosure. The first area 41 comprise more uniform tombstones 47 that lie at ground level and may complete the aesthetic appearance of a track area 29. Moreover, for at least the reason of their proximity to other tombstones 49, the first area 41 may be marketed as a cheaper area to purchase than other areas of the themed cemetery system 1. The second area 43 of the track area 29 may be marketed by the facility owners as a more expensive, larger plot area of the themed cemetery system 1. More ornate tombstones 51 are located in this second area 43 than those present in the first area 41 of the track area 29. The tombstones 51 may include larger headstones 55, mausoleums 57 and/or more decorative and specific memorials 59. These specific memorials 59 may include figurines, such as large figurines, e.g., racing cars 61, favorite players/drivers, favorite number designators 63, and many other optional indicia that may show the deceased's preferred and/or love for a specific pastime.

Still referring to FIG. 2, the themed cemetery system 1 and the continuation of the themed throughout the entire facility is shown, which, in the case of the race car facility 3, may include the general presence of racing flags, such as winner's flags, caution flags, and the like that may be incorporated both figuratively into the ground coverings, and other memorial areas and may even include things like trophies 69 which may be placed ornamentally around the entirety of the race car facility 3 themed cemetery system 1. Additionally, contemplated by the present disclosure is that the second area 43 comprises specific memorials 59 and larger headstones 55, which would likely necessitate larger spaces between a first plot 71 and a second plot 73, whereby walkways 39 may be incorporated between a first plot 71 and a second plot 73, wherein vegetation 31 may be incorporated into the spaces therebetween.

Still referring to FIG. 2, the winner's circle area 25 of the themed cemetery system 1 is shown. The winner's circle area 25 may be set up similarly to the winner's circle of the real world facility. Moreover, the winner's circle area 25 may be marked with ornate decorations, such as vegetation 31 and trophies 69. Additionally, contemplated is that the winner's circle is utilizable as a burial place for those wishing to be buried in this specific area, whereby the facility owner may choose to charge a premium for burial at that specific location or may use the winner's circle as a visitor's area only with seating areas and the like set up. The winner's circle 25 may be at a focal point to the entire themed cemetery system 1, whereby the grandstand areas 5 and the track area 29 all encircle the winner's circle 25 which may increase the value and location of the burial spots close to the winner's circle 25. Individuals may wish to be buried near that area as many people will desire to visit this area because of its unique ornamentation including plaques and potentially other memorabilia from actual races/sporting events.

Still referring to FIG. 2, the Outside edge 79 of the second area 43 of the track area 29 is shown. As can be seen, larger headstones 55 are located in this area which may be adjacent to the winner's circle 25. Moreover, statues 81 may also be placed in this area. In an exemplary embodiment, a statute 81, representing the likeness of a deceased individual, may be disposed, whereby the individual statue 81 may be wearing their favorite jacket/article 83 of clothing having the indicia of the sporting event or the racing number 85 of their favorite driver thereon. The statue 81 is displayable for demonstrating the deceased individual's love and enthusiasm for a particular sport, event, or a particular individual, driver, or the like, yet still maintains a personalized touch of bearing the likeness of the deceased individual. Again, the use of the deceased individuals' pastimes may bring joy and fond memories to those visitors that are visiting the themed cemetery system 1. The atmosphere may also play a part in encouraging the fond memories of visitors that come into the themed cemetery system 1 such that they may re-live some of the experiences that they may have had with their departed loved ones.

Figure 3:
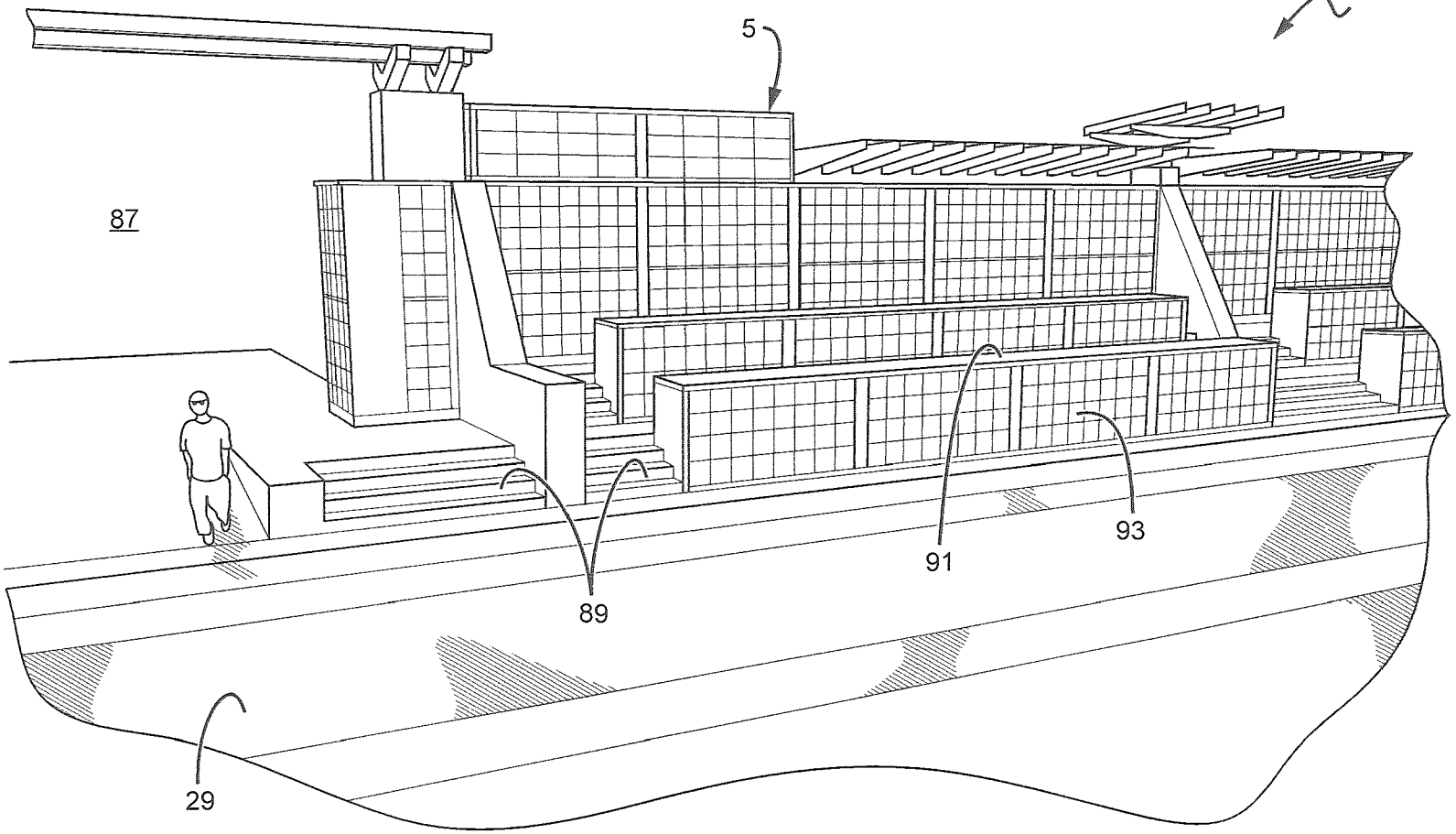
FIG. 3 is a schematic diagram illustrating a perspective view of a themed cemetery system, including a winning circle area, in accordance with an embodiment of the present disclosure.

Referring to FIG. 3, the grandstand area 5 and the entrance area 87 of the themed cemetery system 1 are shown, in accordance with an embodiment of the present disclosure. As can be appreciated, the entrance area 87 may lead directly onto the track area 29 and into the grandstand area 5 as would be normally found in a real world facility. Facility owners may also lease the space in the entrance area, or the outside surface of the themed cemetery system 1 to potential sponsors and/or advertisers that may wish to advertise and sponsor the facility. This may allow for increased revenue in the themed cemetery system 1 and may also lead to the credibility of the facility as many of the real world facilities have similar sponsorships and advertising appearances throughout the entire facility. For example, if a stadium has advertisements placed along the outfield wall, the themed cemetery system 1 may lease the space to potential sponsors or businesses that wish to lease the space which would make the themed cemetery system 1 look similar to the real world stadium advertisements that people have come accustomed to seeing in the real world facility.

Still referring to FIG. 3, the grandstand area 5 with stairs 89 leading to the grandstand area 5 and stairs 89 leading to the track area 29 is shown. The grandstand area 5 may have a plurality of walls 91 which may separate the grandstand areas 5 from the track area 29. The walls 91 are configured to accept urns holding the cremated remains of the deceased. Each section of the wall 91 comprises plaques 93 located thereon which may identify the final resting place of the individuals accommodated, e.g., interred, within that area. Understood is that the walls 91 comprise a sufficient thickness to allow for a plurality of cremated remains to be placed within them, along with the plaques 93 which identify the individual's identity. Also included in the grandstand area 5 as illustrated in FIG. 1 may be a seating area for visitors to come and spend time at the themed cemetery system 1 when visiting loved ones.

Figure 4:
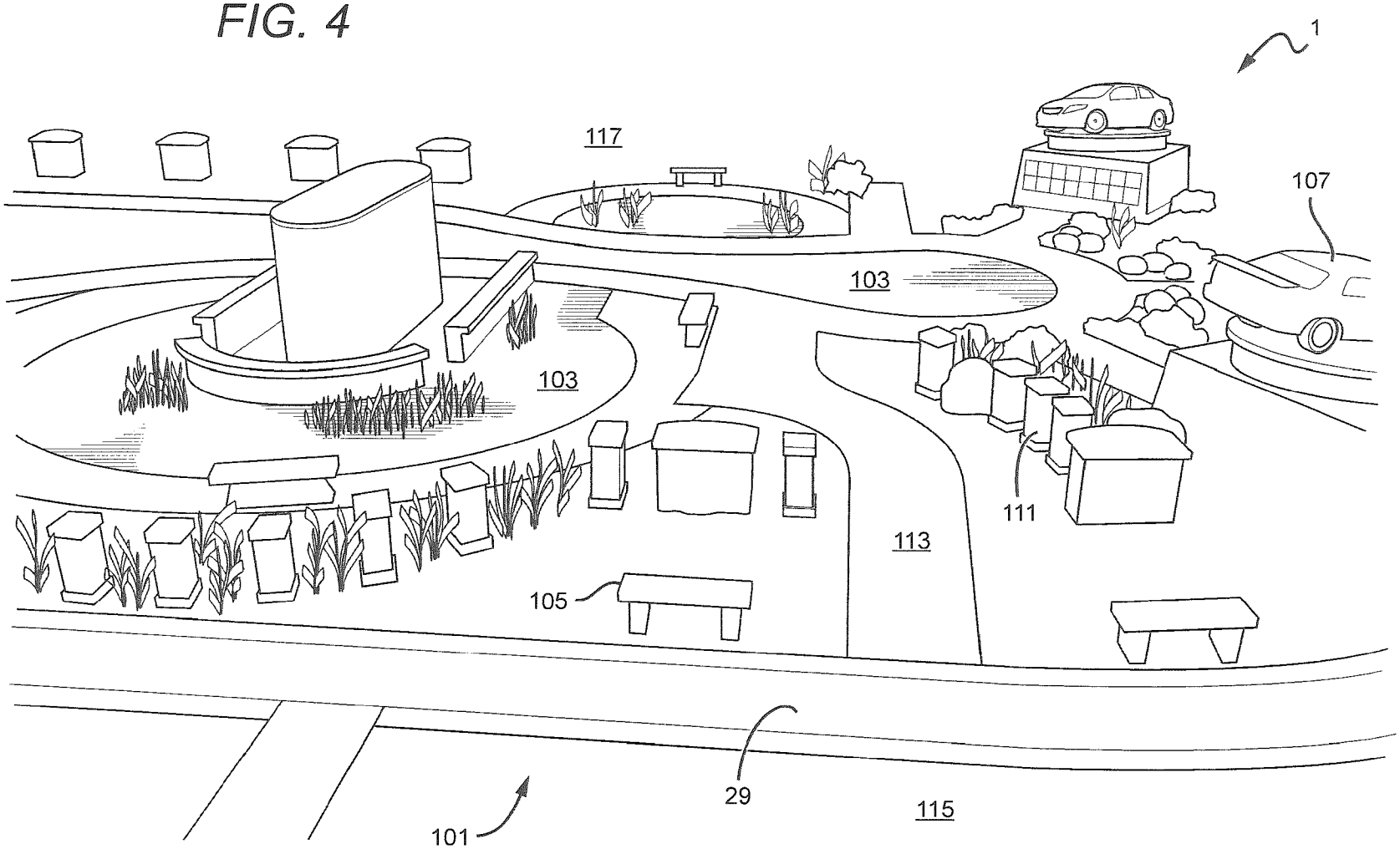
FIG. 4 is a schematic diagram illustrating a perspective view of a themed cemetery system, including a inner green area, in accordance with an embodiment of the present disclosure.
Figure 5:
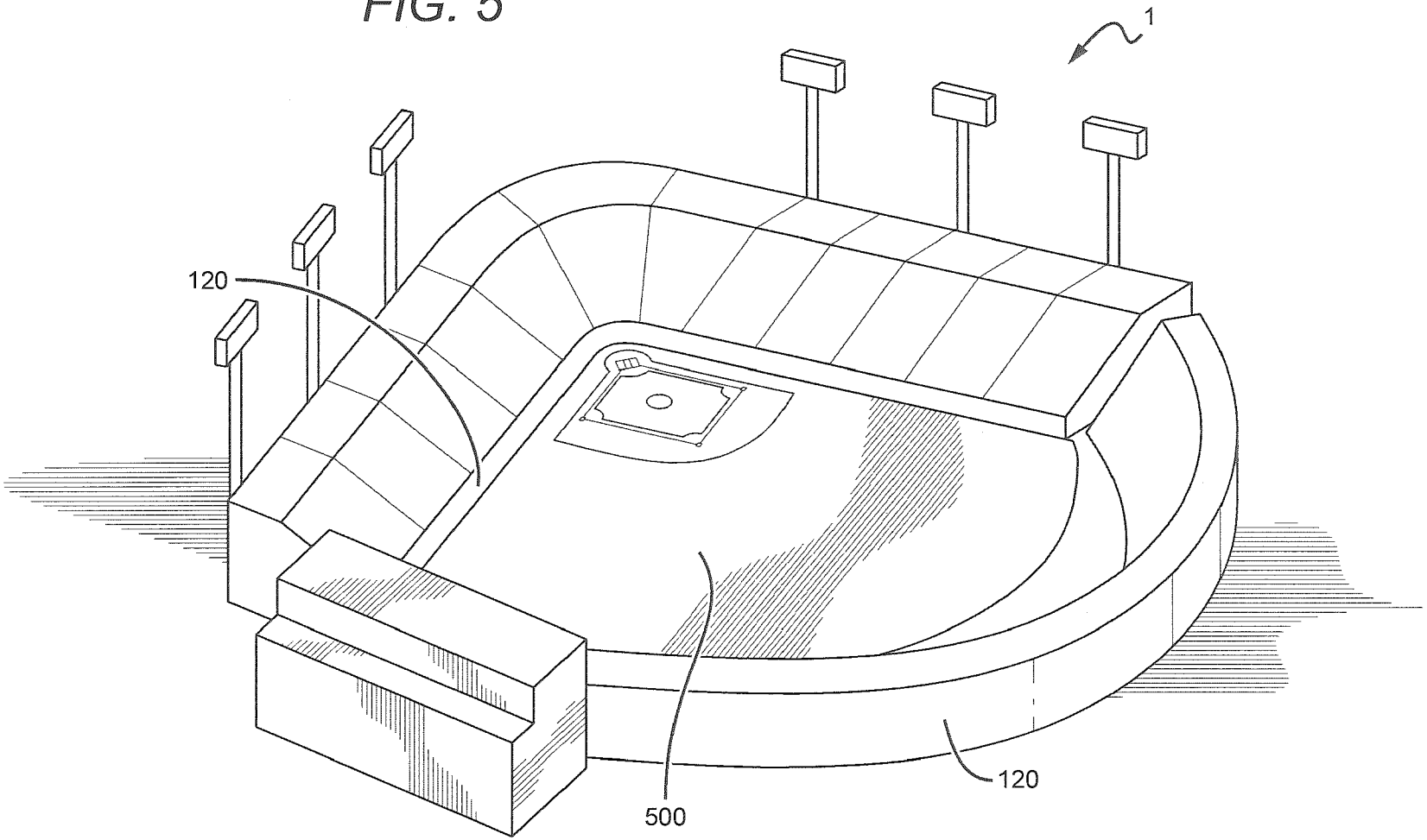
FIG. 5 is a schematic diagram illustrating a perspective view of a themed cemetery system, comprising a stadium configuration, in accordance with an embodiment of the present disclosure.
Figure 6:
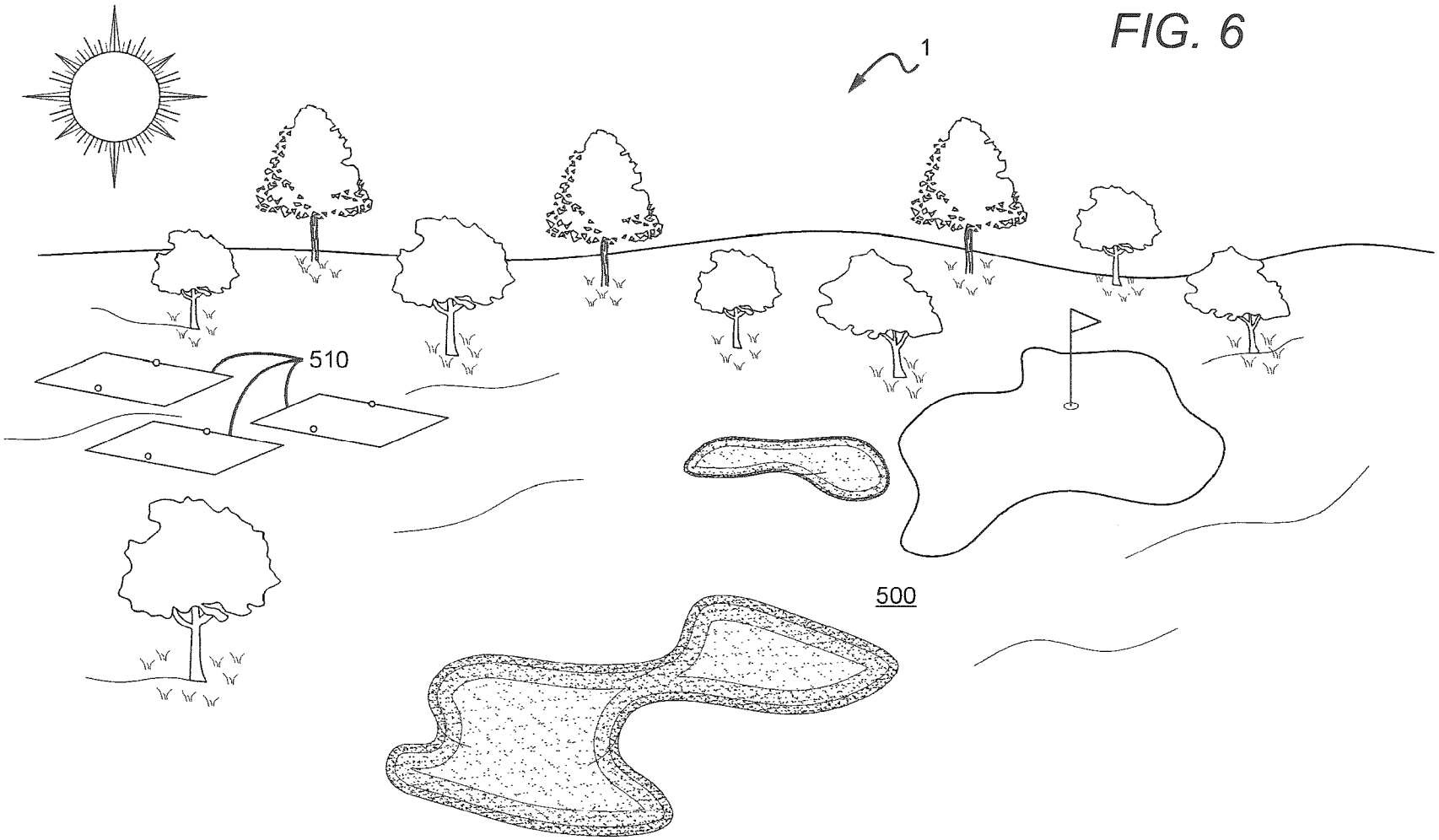
FIG. 6 is a schematic diagram illustrating a perspective view of a themed cemetery system, comprising a golf course configuration, in accordance with an embodiment of the present disclosure.
Figure 7:
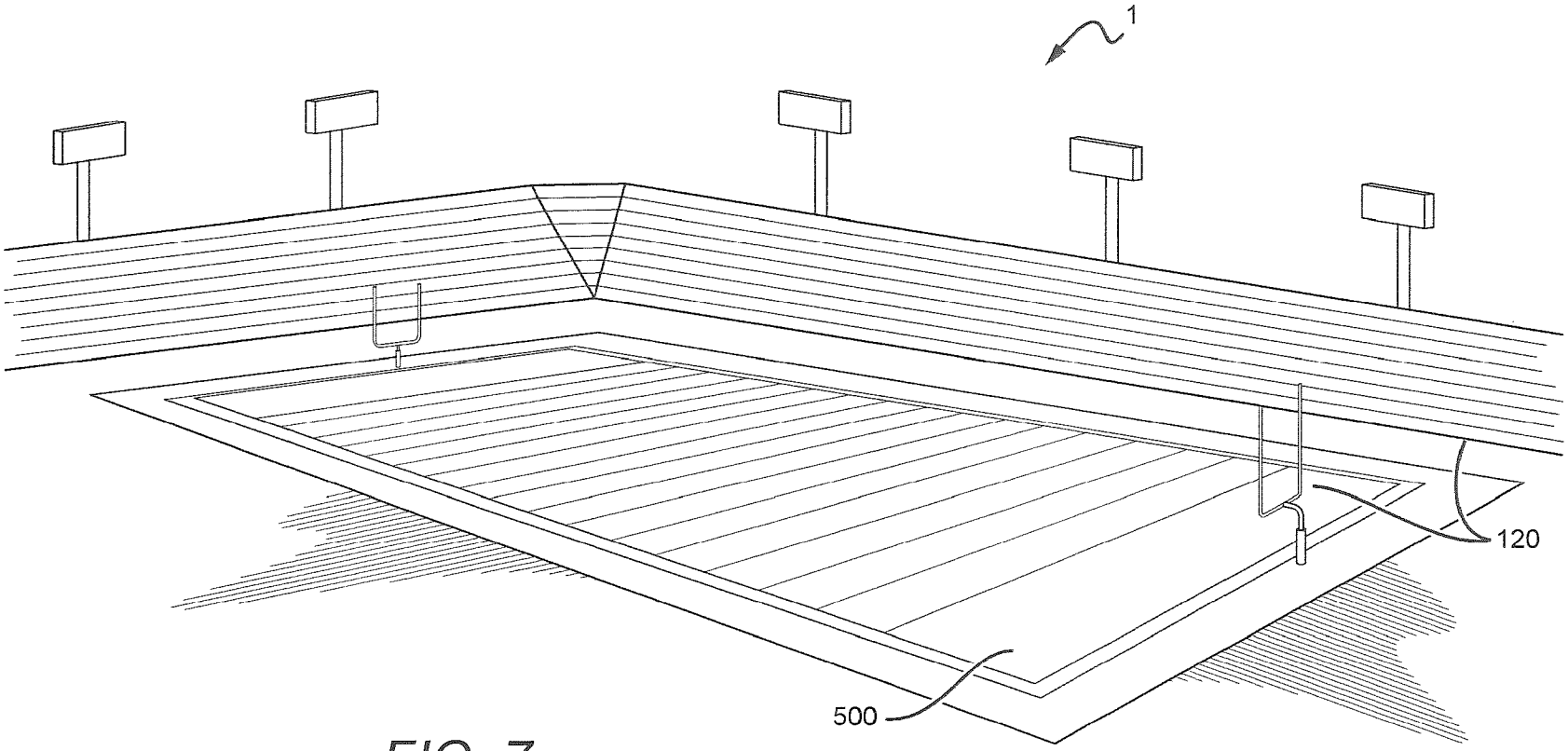
FIG. 7 is a schematic diagram illustrating a perspective view of a themed cemetery system, comprising a football field configuration, in accordance with an embodiment of the present disclosure.
Figure 8:
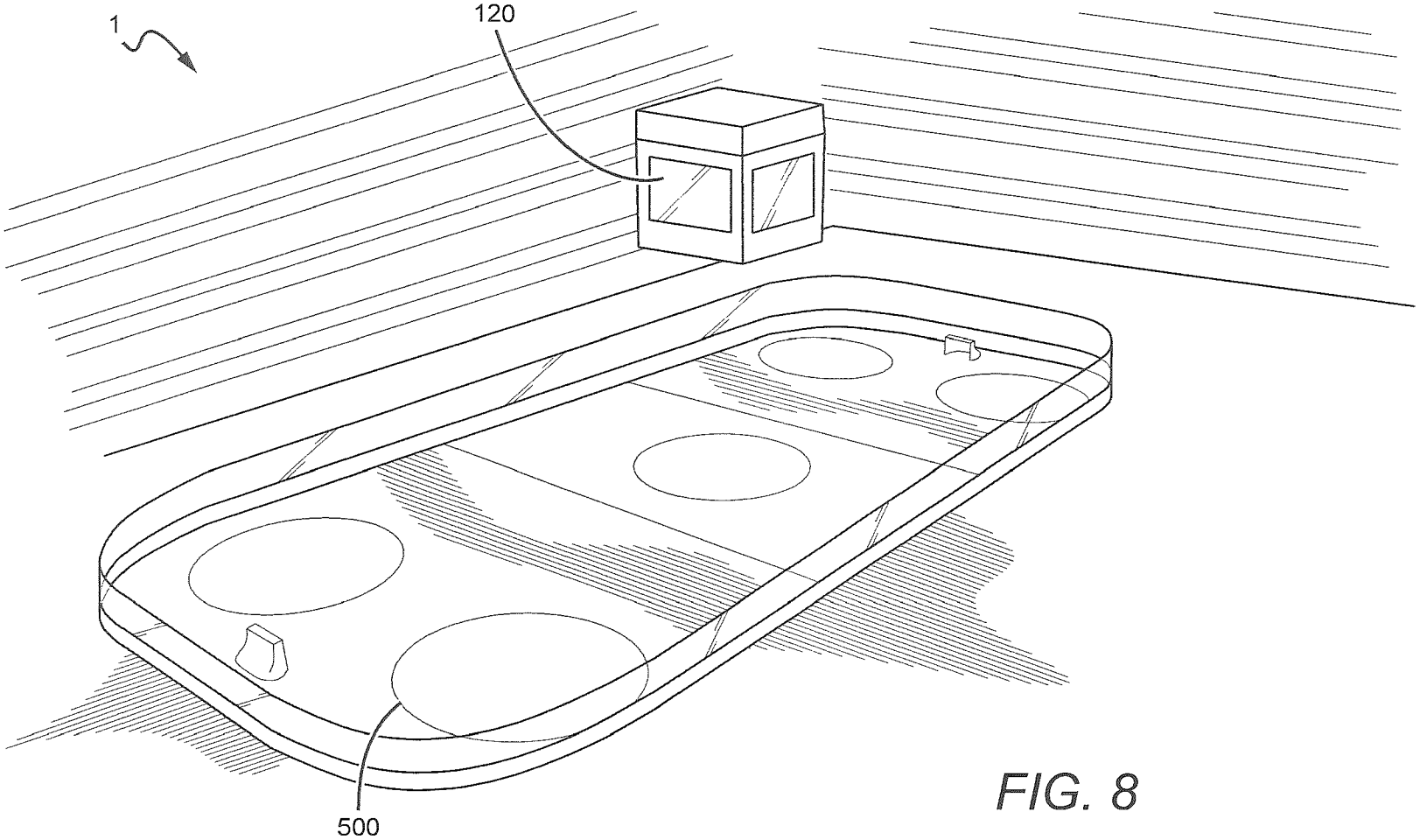
FIG. 8 is a schematic diagram illustrating a perspective view of a themed cemetery system, comprising a basketball court configuration, in accordance with an embodiment of the present disclosure.
Figure 9:
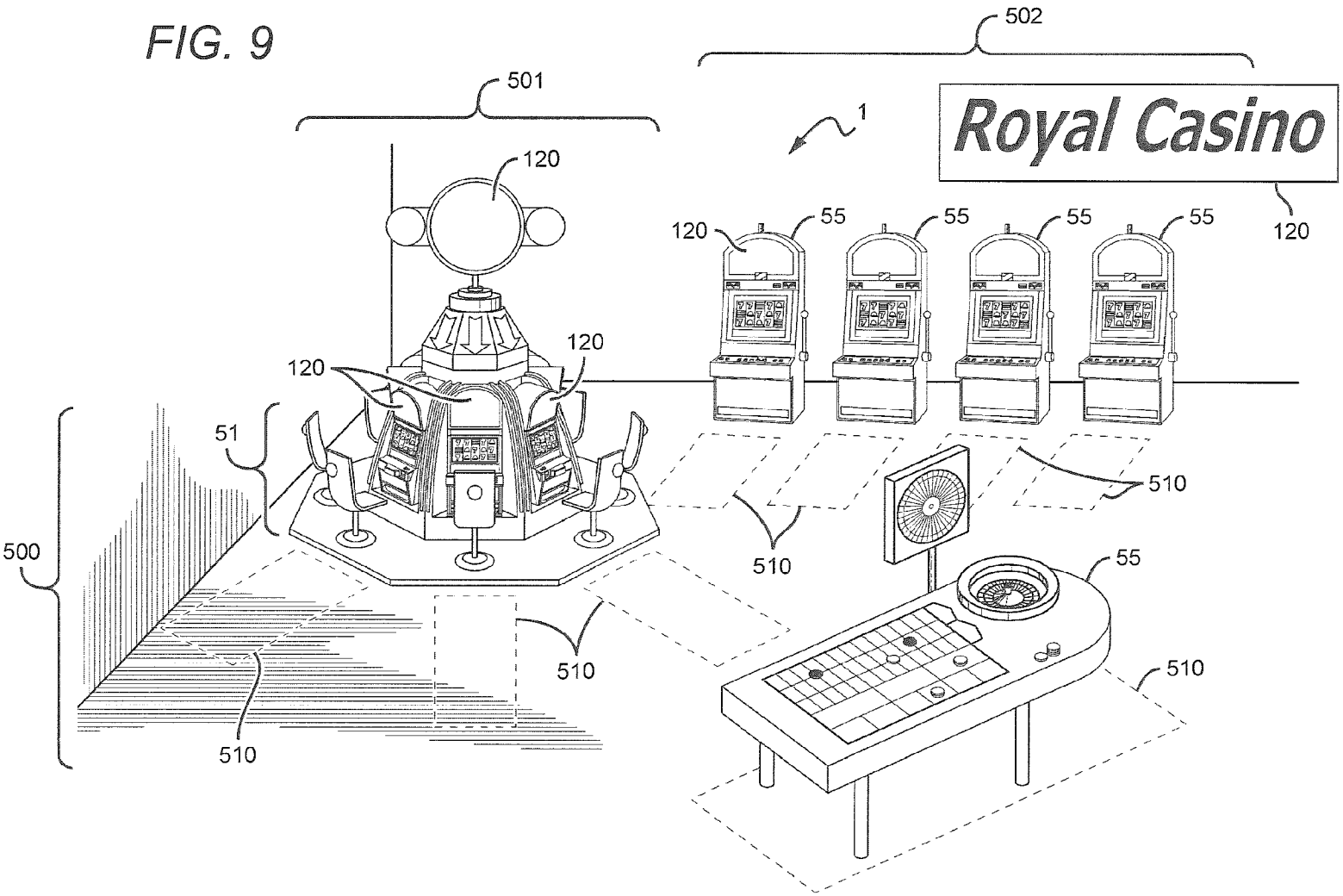
FIG. 9 is a schematic diagram illustrating a perspective view of a themed cemetery system, comprising a casino configuration, in accordance with an embodiment of the present disclosure.
Figure 10:
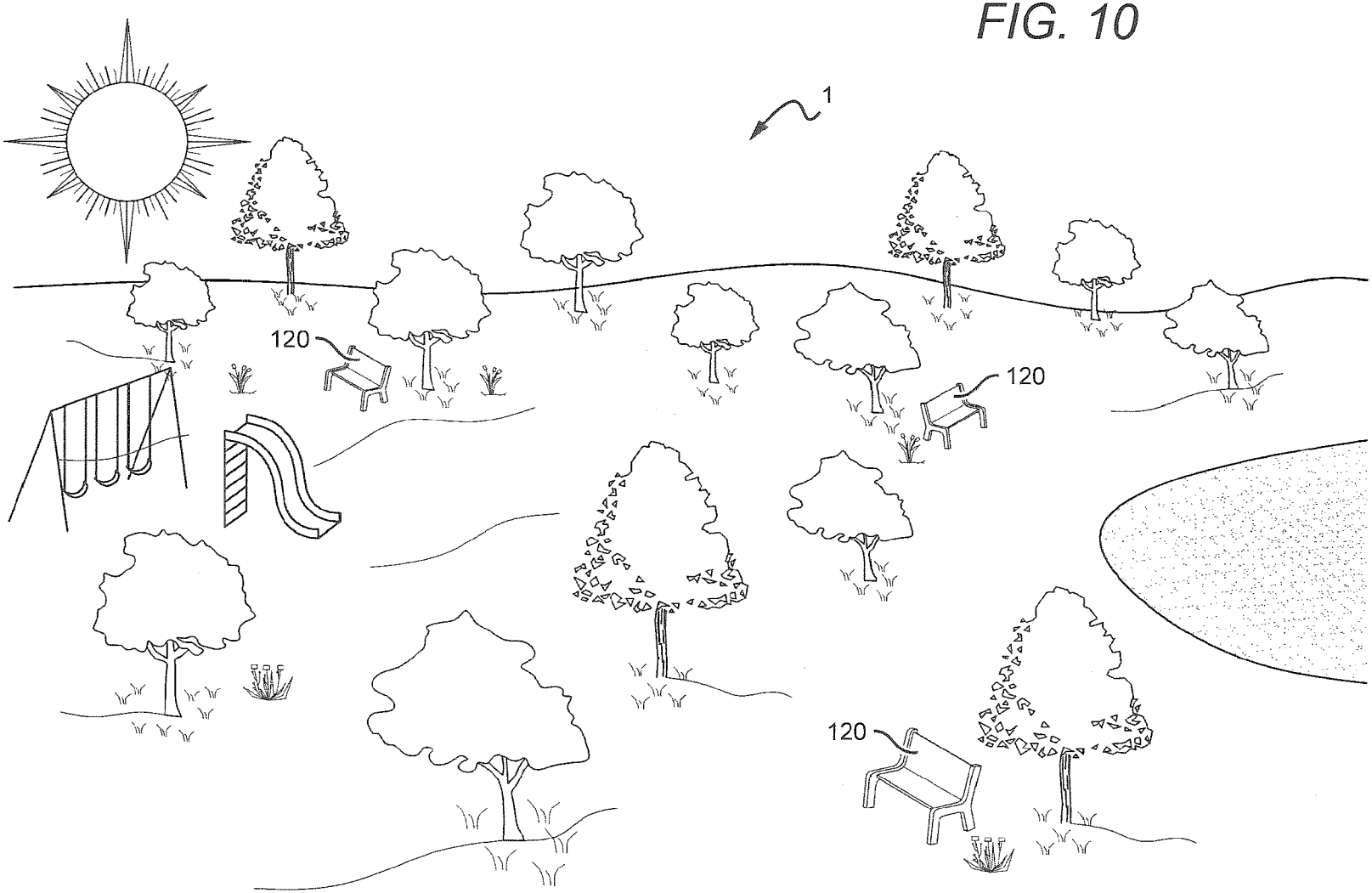
FIG. 10 is a schematic diagram illustrating a perspective view of a themed cemetery system, comprising a playground or park configuration, in accordance with an embodiment of the present disclosure.

Referring to FIG. 4, the inner field area 101 of the themed cemetery system 1 is shown, in accordance with an embodiment of the present disclosure. The inner field area 101 may continue the themed of the facility. In this exemplary embodiment, the inner field area 101 of a race car facility may comprise mechanic pits and other holding areas. In this particular embodiment, it may be more desirable to have an inner field area 101 which may be more park like with ponds 103, seating areas 105 and other ornamental features 107 which are still consistent with the overall themed cemetery system 1 which may include pedestals 111 having cars, trophies and other activities associated with the themed. Additionally, walkways 113 are provided to allow walking from one side 115 of the track area 29 to a second side 117 of the track area 29. Other ornamental features and characteristics may be provided to enhance the themed of the cemetery while not detracting from the aesthetic pleasure of the surrounding areas.

Referring to FIGS. 5-10, the themed cemetery system 1 comprises any of a plurality of shapes and sizes, depending on the desires and accommodations necessary for those wishing to be accommodated, e.g., interred, at the location, in accordance with alternative embodiments of the present disclosure. For example, the themed cemetery system 1 may take the form of a baseball stadium (FIG. 5), a football stadium (FIG. 7), a hockey arena (FIG. 8), golf course (FIG. 6), a park (FIG. 10), and/or an entertainment venue, such as a casino (FIG. 9), by example only. Advertising and promotional space may also be provided within the themed cemetery system 1 to coincide with the advertising and promotional space provided at the corresponding facility after which the themed cemetery system is represented. For example, the advertising and promotional space 120 may be disposed on an outside wall of the modeled facility of the themed cemetery system 1.

Referring to FIGS. 5-8, a themed cemetery system 1 comprises: a property simulating a entertainment facility comprising at least one entertainment themed, the property comprising: at least one portion simulating at least one entertaining area 500 of the entertainment facility; a plurality of burial plots 510 located in relation to the property simulating the entertainment facility, each plot 510 of the plurality of burial plots 510 capable of accommodating at least one of a casket (not shown), an urn (not shown), a mausoleum (not shown), and contents thereof (not shown), each plot 510 comprising a distinct revenue value relative to any other plot 510 at a given time, and the distinct revenue value depending on a location of each plot 510 within the property simulating the entertainment facility; and at least a portion 502 comprising at least one advertising space, such as the advertising and promotional space 120, in accordance with an alternative embodiment of the present disclosure.

Still referring to FIGS. 5-8, the at least one entertainment themed comprises at least one of live theatre, cinema, concert, an art exhibition, a television, radio, gambling, convening, resort, and any other form of entertainment, wherein entertainment includes music, art, performing art, cinema, television, any other amusement associated with a venue. The at least one advertising space, such as the advertising and promotional space 120, is disposed in relation to at least one wall 91 of the property and is disposed on the property in manner that is consistent with at least one advertising and promotional space of the entertainment facility, e.g., the facility after which the themed cemetery represents, such as the Grauman's Chinese Theatre, the Hollywood Bowl, The Hollywood Palladium, Disneyland, The Walt Disney Concert Hall, The Greek Theatre, Cesar's Palace, The MGM Grand Hotel, The Bellagio, and the like.

Still referring to FIGS. 5-8, the system 1 further comprises burial headstones 512 having memorabilia related to the entertainment facility. The property further comprises at least one seating area, such as seating areas 7, 37. The at least one entertaining area 500 comprises a first area 501 and a second area 502, the first area 501 comprising a plurality of generally uniform, ground level tombstones 51 at a first revenue value, and the second area comprising a plurality of ornate tombstones 55 at a second revenue value, the second revenue value being higher than the first revenue value (See also. FIG. 2). The plurality of generally ground level tombstones 51 of the first area are disposed in a manner resembling a entertaining surface for the entertainment facility. The plurality of ornate tombstones 55 of the second area comprises a plurality of headstones (not shown) corresponding to a plurality of specific memorials. The plurality of specific memorials comprises at least one at least one representation (not shown) of an entertainment poster, a stage actor, a movie star, a television star, a celebrity, an entertainment personality, a studio owner, a studio executive, a reality show personality, an online personality, a newscaster, a broadcaster, and the like. The first area 501 comprises a plurality of ornamental features (not shown) consistent with the at least one entertainment themed of the entertainment facility.

Still referring to FIGS. 5-8, a method of creating a themed cemetery system 1 comprises: providing a property simulating a entertainment facility comprising at least one entertainment themed, the property comprising: providing at least one portion simulating at least one entertaining area 500 of the entertainment facility; providing a plurality of burial plots 510 located in relation to the property simulating the entertainment facility, each plot 510 of the plurality of burial plots 510 capable of accommodating at least one of a casket (not shown), an urn (not shown), a mausoleum (not shown), and contents thereof (not shown), each plot 510 comprising a distinct revenue value relative to any other plot 510 at a given time, and the distinct revenue value depending on a location of each plot 510 within the property simulating the entertainment facility; and providing at least a portion comprising at least one advertising space, such as the advertising and promotional space 120, in accordance with another alternative embodiment of the present disclosure, Still referring to FIGS. 5-8, in the method of creating a themed cemetery system 1, providing the at least one entertainment themed comprises providing at least one of live theatre, cinema, concert, an art exhibition, a television, radio, gambling, convening, resort, and any other form of entertainment, wherein entertainment includes music, art, performing art, cinema, television, any other amusement associated with a venue.

Still referring to FIGS. 5-8, in the method of creating a themed cemetery system 1, providing the at least a portion, comprising the at least one advertising space, such as the advertising and promotional space 120, comprises disposing the at least one advertising space in relation to at least one wall, such as the wall 91, of the property; and providing the at least a portion, comprising the at least one advertising space, such as the advertising and promotional space 120, comprises disposing the at least one advertising space on the property in a manner that is consistent with at least one advertising and promotional space of the entertainment facility, e.g., the facility after which the themed cemetery represents, such as Grauman's Chinese Theatre, the Hollywood Bowl, The Hollywood Palladium, Disneyland, The Walt Disney Concert Hall, The Greek Theatre, Cesar's Palace, The MGM Grand Hotel, The Bellagio, and the like. The method further comprises providing burial headstones having memorabilia related to the entertainment facility after which the system 1 represents. Also, the step of providing the property further comprises providing at least one seating area, such as seating areas 7, 37.

Still referring to FIGS. 5-8, in the method of creating a themed cemetery system 1, providing the at least one portion, simulating at least one entertaining area 500, comprises providing the at least one entertaining area 500 with a first area 501 and a second area 502, the first area 501 providing comprising providing generally uniform, ground level tombstones 51 at a first revenue value, and the second area 502 providing comprising providing ornate tombstones 55 at a second revenue value, the second revenue value being higher than the first revenue value. The step of providing the generally ground level tombstones 51 of the first area 501 comprises disposing the generally ground level tombstones 51 in a manner resembling a entertaining surface for the first area 501, wherein providing the ornate tombstones 55 of the second area 502 comprises providing the headstones (not shown) corresponding to specific memorials. The step of providing the headstones corresponding to specific memorials comprises providing at least one representation (not shown) of an entertainment poster, a stage actor, a movie star, a television star, a celebrity, an entertainment personality, a studio owner, a studio executive, a reality show personality, an online personality, a newscaster, a broadcaster, and the like. The step of providing the at least one entertaining area 500 comprises providing the first area 501 with ornamental features consistent with the at least one entertainment themed of the entertainment facility after which the system 1 represents.

Information as herein shown and described in detail is fully capable of attaining the above-described object of the present disclosure, the presently preferred embodiment of the present disclosure, and is, thus, representative of the subject matter which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

What is claimed:

1. A themed cemetery system, comprising:

a property simulating an entertainment facility comprising at least one entertainment theme, wherein the at least one entertainment theme comprises a casino;

the property comprising:

at least one portion simulating at least one entertaining area of the entertainment facility, the property including one or more slot machines and one or more card tables;

a plurality of burial plots located throughout the property simulating the entertainment facility, each plot of the plurality of burial plots capable of accommodating at least one of a casket, an urn, a mausoleum, and contents thereof, each plot comprising a distinct revenue value relative to any other plot at a given time, and the distinct revenue value depending on a location of each plot within the property simulating the entertainment facility; and at least a portion comprising at least one advertising space configured to generate a revenue stream.

2. The system of claim 1, wherein the at least one advertising space is disposed in relation to at least one wall of the property.

3. The system of claim 1, wherein the at least one advertising space is disposed on the property in manner that is consistent with at least one advertising and promotional space of the entertainment facility.

4. The system of claim 1, further comprising a plurality of burial headstones having memorabilia related to the entertainment facility.

5. The system of claim 1, wherein the property further comprises at least one seating area.

6. The system of claim 1, wherein the at least one portion simulating at least one entertaining area comprises a first area and a second area, the first area comprising a plurality of generally uniform, ground level tombstones at a first revenue value, and the second area comprising a plurality of ornate tombstones at a second revenue value, the second revenue value being higher than the first revenue value.

7. The system of claim 6, wherein the plurality of generally ground level tombstones of the first area are disposed in a manner resembling an entertaining surface for the entertainment facility.

8. The system of claim 6, wherein the plurality of ornate tombstones of the second area comprises a plurality of headstones corresponding to a plurality of specific memorials.

9. The system of claim 8, wherein the plurality of specific memorials comprises at least one representation of an entertainment poster, a stage actor, a movie star, a television star, a celebrity, an entertainment personality, a studio owner, a studio executive, a reality show personality, an online personality, a newscaster, or a broadcaster.

10. The system of claim 6, wherein the first area comprises a plurality of ornamental features consistent with the at least one entertainment theme of the entertainment facility.

11. A method for creating a themed cemetery, the method comprising:

providing a property simulating an entertainment facility comprising at least one live entertainment venue theme providing at least one portion simulating at least one entertaining area of the entertainment facility, the portion including a stage and one or more seating areas directed toward the stage;

providing a plurality of burial plots located throughout the property simulating the entertainment facility, each plot of the plurality of burial plots capable of accommodating at least one of a casket, an urn, a mausoleum, and contents thereof, each plot comprising a distinct revenue value relative to any other plot at a given time, and the distinct revenue value depending on a location of each plot within the property simulating the entertainment facility; and providing at least a portion comprising at least one advertising space configured to generate a revenue stream, wherein at least a first subsection of the burial plots is located within the stage and at least a second subsection of the burial plots is located among the one or more seating areas.

12. The method of claim 11, wherein providing the at least a portion, comprising the at least one advertising space, comprises disposing the at least one advertising space in relation to at least one wall of the property.

13. The method of claim 11, wherein providing the at least a portion, comprising the at least one advertising space, comprises disposing the at least one advertising space on the property in a manner that is consistent with at least one advertising and promotional space of the entertainment facility.

14. The method of claim 11, further comprising providing a plurality of burial headstones having memorabilia related to the entertainment facility.

15. The method of claim 11, wherein providing the at least one portion, simulating at least one entertaining area, comprises providing the at least one entertaining area with a first area and a second area, the first area providing generally uniform, ground level tombstones at a first revenue value, and the second area providing ornate tombstones at a second revenue value, the second revenue value being higher than the first revenue value.

16. The method of claim 15, wherein providing the plurality of generally ground level tombstones of the first area comprises disposing the generally ground level tombstones in a manner resembling an entertaining surface for the first area, wherein providing the plurality of ornate tombstones of the second area comprises providing the headstones corresponding to specific memorials, and wherein providing the plurality of headstones corresponding to specific memorials comprises providing at least one representation of an entertainment poster, a stage actor, a movie star, a television star, a celebrity, an entertainment personality, a studio owner, a studio executive, a reality show personality, an online personality, a newscaster, or a broadcaster.

17. The method of claim 15, wherein providing the at least one portion simulating at least one entertaining area comprises providing the first area with ornamental features consistent with the at least one entertainment theme of the entertainment facility.

* * * * *